US005418326A

United States Patent [19]

Ikeda et al.

[11] Patent Number: 5,418,326

[45] Date of Patent: May 23, 1995

[54] AUTOMATIC ACCOMPANIMENT INSTRUMENT FOR AUTOMATICALLY PERFORMING AN ACCOMPANIMENT THAT IS BASED ON A CHORD PROGRESSION FORMED BY A SEQUENCE OF CHORDS

[75] Inventors: Takashi Ikeda; Satoshi Suzuki, both of Hamamatsu, Japan

[73] Assignee: Yamaha Corporation, Hamamatsu, Japan

[21] Appl. No.: 157,612

[22] Filed: Nov. 24, 1993

[30] Foreign Application Priority Data

Nov. 24, 1992 [JP] Japan ..... 4-336668

[51] Int. Cl.[6] ..... G10H 1/38

[52] U.S. Cl. ..... 84/637; 84/669; 84/DIG. 22

[58] Field of Search ..... 84/613, 637, 650–652, 84/669, 715, DIG. 22

[56] References Cited

U.S. PATENT DOCUMENTS 4,470,332 9/1984 Aoki ..... 84/DIG. 22
4,656,911 4/1987 Sakurai ..... 84/DIG. 22

FOREIGN PATENT DOCUMENTS 63-193199 8/1988 Japan .
4133096 5/1992 Japan .

*Primary Examiner*—Stanley J. Witkowski
*Attorney, Agent, or Firm*—Spensley Horn Jubas & Lubitz

[57] ABSTRACT

An automatic accompaniment instrument detects a change in a chord progression formed of a sequence of chords. A pitch of an accompaniment tone to be reproduced is controlled based on a present chord and/or an immediately following chord of the chord progression, as well as on a pitch of an accompaniment tone generated on an immediately preceding occasion, when a change in the chord progression is detected.

20 Claims, 6 Drawing Sheets

AUTOMATIC ACCOMPANIMENT INSTRUMENT FOR AUTOMATICALLY PERFORMING AN ACCOMPANIMENT THAT IS BASED ON A CHORD PROGRESSION FORMED BY A SEQUENCE OF CHORDS

BACKGROUND OF THE INVENTION

1. Field of the Invention

This invention relates to an automatic accompaniment instrument which is adapted to automatically generate accompaniment tones such as chord background tones, bass tones, and percussion instrument tones according to a predetermined pattern, based on a chord progression, a kind of rhythm, etc. which have been designated.

2. Prior Art

An automatic accompaniment instrument has already been proposed, e.g. by Japanese Provisional Patent Publication (Kokai) No. 63-193199, which reads accompaniment data from accompaniment pattern data stored in C major key, and then subject the read accompaniment data to pitch conversion according to a chord input thereto, to thereby reproduce an accompaniment tone. According to this proposed instrument, the pitch conversion of accompaniment data is performed by controlling the pitch of an accompaniment none according to the type of the input chord and a difference in pitch between the root of the input chord and the read accompaniment data, and then shifting the pitch of the accompaniment data according to the root of the input chord.

However, according to the proposed instrument, the pitches of accompaniment tones are sequentially controlled by chords input thereto. As a result, if the chord is changed, this can result in a large difference in pitch between a tone generated based on a chord immediately preceding the change and a tone generated based on a chord immediately following the change, causing an unnaturalness in the flow of accompaniment tones reproduced.

SUMMARY OF THE INVENTION

It is an object of the invention to provide an accompaniment instrument which is capable of producing accompaniment tones without causing an unnaturalness or awkwardness in the flow of accompaniment tones reproduced even when the input chord is changed.

To attain the object, the present invention provides an automatic accompaniment instrument for automatically performing accompaniment in dependence on a chord progression formed of a sequence of chords.

According to a first aspect of the invention, the automatic accompaniment instrument is characterized by comprising chord change-detecting means for detecting a change in the chord progression, accompaniment tone control means responsive to an output from the chord change-detecting means, for controlling a pitch of an accompaniment tone to be reproduced, based on at least one of a present chord and an immediately following chord of the chord progression, as well as on a pitch of an accompaniment tone generated on an immediately preceding occasion, when a change in the chord progression is detected.

Preferably, the pitch of the accompaniment tone to be reproduced is controlled based on the pitch of the accompaniment tone generated on the immediately preceding occasion, and the present chord of the chord progression, when the change in the chord progression has just occurred.

More preferably, the pitch of the accompaniment tone to be reproduced is set to a pitch of a tone which is close to the pitch of the accompaniment tone generated on the immediately preceding occasion and has a pitch name identical to a root of the present chord of the chord progression.

Alternatively, the pitch of the accompaniment tone to be reproduced is controlled based on the pitch of the accompaniment tone generated on the immediately preceding occasion, and the immediately following chord of the chord progression, when the change in the chord progression is about to occur.

More preferably, if there is any at least one chord constituent tone corresponding to the present chord of the chord progression falling between the pitch of the accompaniment tone generated on the immediately preceding occasion and a pitch of a tone falling within a predetermined tone range and having a pitch name identical to a root of the immediately following chord of the chord progression, the pitch of the accompaniment tone to be reproduced is set to a pitch of one of the any at least one chord constituent tone corresponding to the present chord which is close to the pitch of the tone falling within the predetermined tone range and having the pitch name identical to the root of the immediately following chord of the chord progression.

Also preferably, if there is no chord constituent tone corresponding to the present chord of the chord progression falling between the pitch of the accompaniment tone generated on the immediately preceding occasion and a pitch of a tone falling within a predetermined tone range and having a pitch name identical to a root of the immediately following chord of the chord progression, the pitch of the accompaniment tone to be reproduced is set according to a difference between the pitch of the accompaniment tone generated on the immediately preceding occasion and the pitch of the tone falling within the predetermined tone range and having the pitch name identical to the root of the immediately following chord of the chord progression.

According to a second aspect of the invention, the automatic accompaniment instrument is characterized by comprising chord change-detecting means for detecting a change in the chord progression, and accompaniment tone control means responsive to an output from the chord change-detecting means, for controlling a pitch of an accompaniment tone to be reproduced, based on at least one of a present chord and an immediately following chord of the chord progression.

Preferably, the automatic accompaniment instrument includes scale-selecting means for selecting a scale of the accompaniment tone to be reproduced, and the pitch of the accompaniment tone to be reproduced is controlled in dependence on a key of a scale selected by the scale-selecting means.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
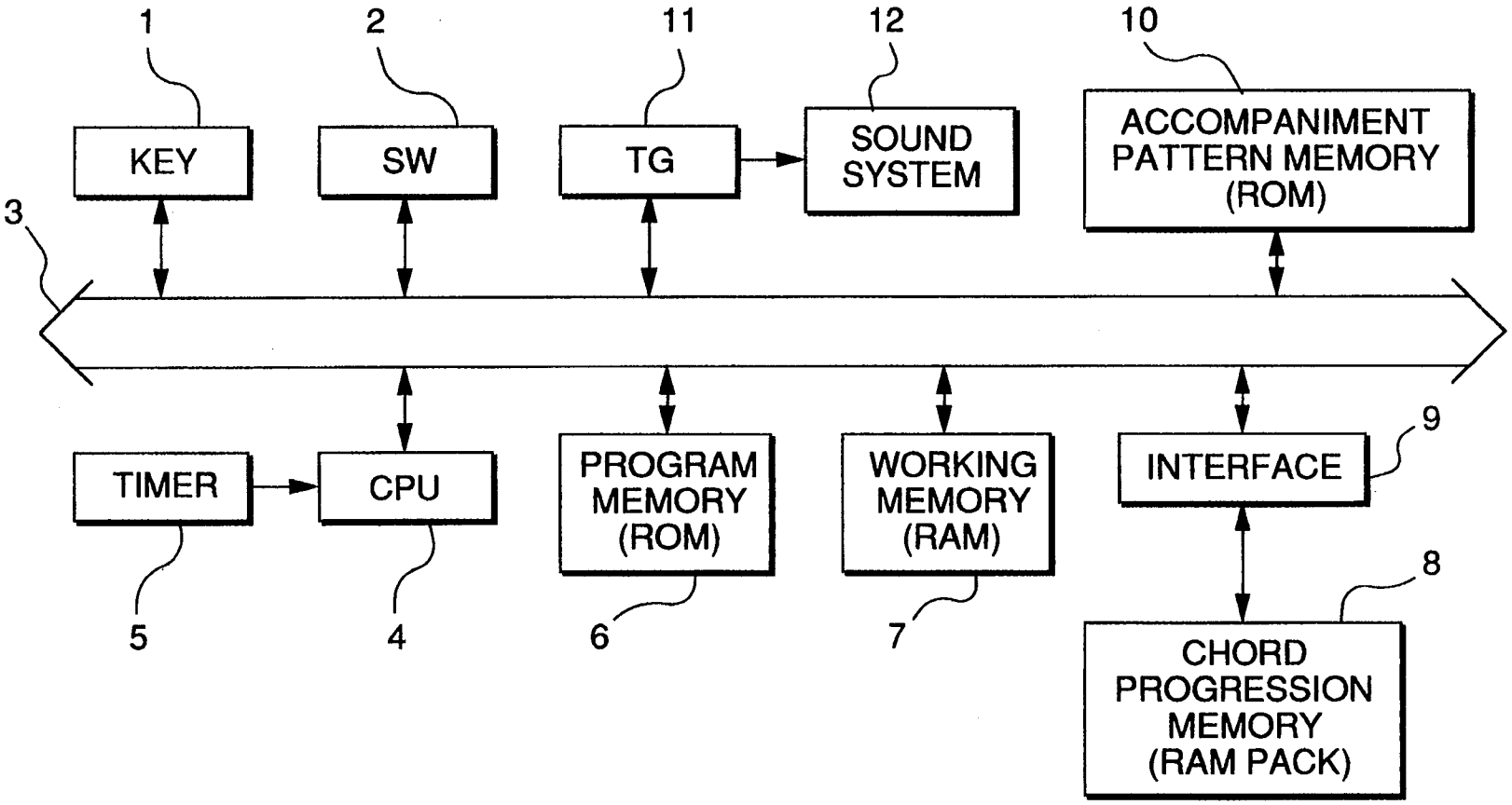
FIG. 1 is a block diagram showing the whole arrangement of an electronic musical instrument incorporating an automatic accompaniment instrument according to an embodiment of the invention.

FIG. 1 shows the whole arrangement of an electronic musical instrument equipped with an automatic accompaniment instrument according to the embodiment. In FIG. 1, a keyboard 1 and a switch panel 2 are connected via a bus 3 to a central processing unit (CPU) 4, for supplying the CPU 4 with signals indicative of statuses of keys of the keyboard 1 (e.g. a key-on signal, and a key code signal) and signals indicative of operative states of various switches arranged on the switch panel 3, respectively. The switches arranged on the switch panel 2 include a start/stop switch for instructing start or stoppage of automatic accompaniment, a style-selecting switch for selecting a style of automatic accompaniment; and a key-setting switch for settling a key of a scale, neither of which is shown.

A timer 5 is connected to the CPU 4, which supplies a clock signal to the CPU 4. Further connected via the bus 3 to the CPU 4 are a program memory 6, a working memory 7, an interface 9 connected to a chord progression memory 8, an accompaniment pattern memory 10, and a tone generator 11. The tone generator 11 is connected to a sound system 12 comprised of a digital-to-analog (D/A) converter, an amplifier, a loudspeaker, etc., none of which is shown.

The CPU 4 controls various processing operations according to the statuses of the keys of the keyboard 1 and the operative states of the switches of the switch panel 2. More specifically, the CPU 4 controls processing operations described hereinafter with reference to FIG. 3 to FIG. 5B according to programs stored in the program memory 6, thereby delivering a signal for causing the tone generator 11 to generate a musical tone signal. The sound system 12 converts the musical tone signal into a musical tone.

The program memory 6 and the accompaniment pattern memory 10 are formed by ROM's (Read Only Memories) storing programs on which the CPU 4 operates, and data of accompaniment patterns, respectively. The accompaniment pattern memory 10 stores the data of accompaniment patterns separately for each of chord background part, bass part, and percussion instrument part. When a style number is designated by the style-selecting switch, desired accompaniment patterns for the respective parts are read out from the accompaniment pattern memory 10. The working memory 7 is formed by a RAM (Random Access Memory) for temporarily storing data produced in the course of computation and data of accompaniment patterns selected during execution of the automatic accompaniment.

Figure 2:
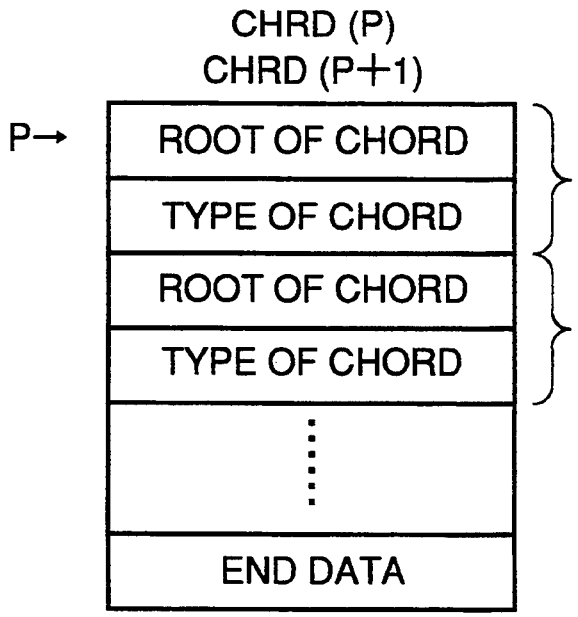
FIG. 2 is a diagram showing how data is stored in a chord progression memory.

The chord progression memory 8 is formed by a RAM pack which is removable from the main body of the electronic musical instrument, and in which chord progression data of pieces of music to be played back (each data item of which is denoted by CHRD (P)) is stored in an array as shown in FIG. 2. More specifically, the chord progression memory 8 sequentially stores sets of data items of chords, each set consisting of a data item CHRD (P) of a root of a chord and a data item CHRD (P+1) of the type of the chord, and an end data item at the terminal address thereof. The symbol P represents an indication value of an address pointer, not shown, which represents the number of an address of the chord progression memory 8 to be selected. In this connection, the data item CHRD (P) of the root of the chord is not pitch data indicating a particular pitch, but it is pitch name data indicating a pitch name, such as "Do".

Next, details of processing operations executed by the CPU 4 will be described with reference to FIG. 3 to FIG. 5B.

Figure 3:
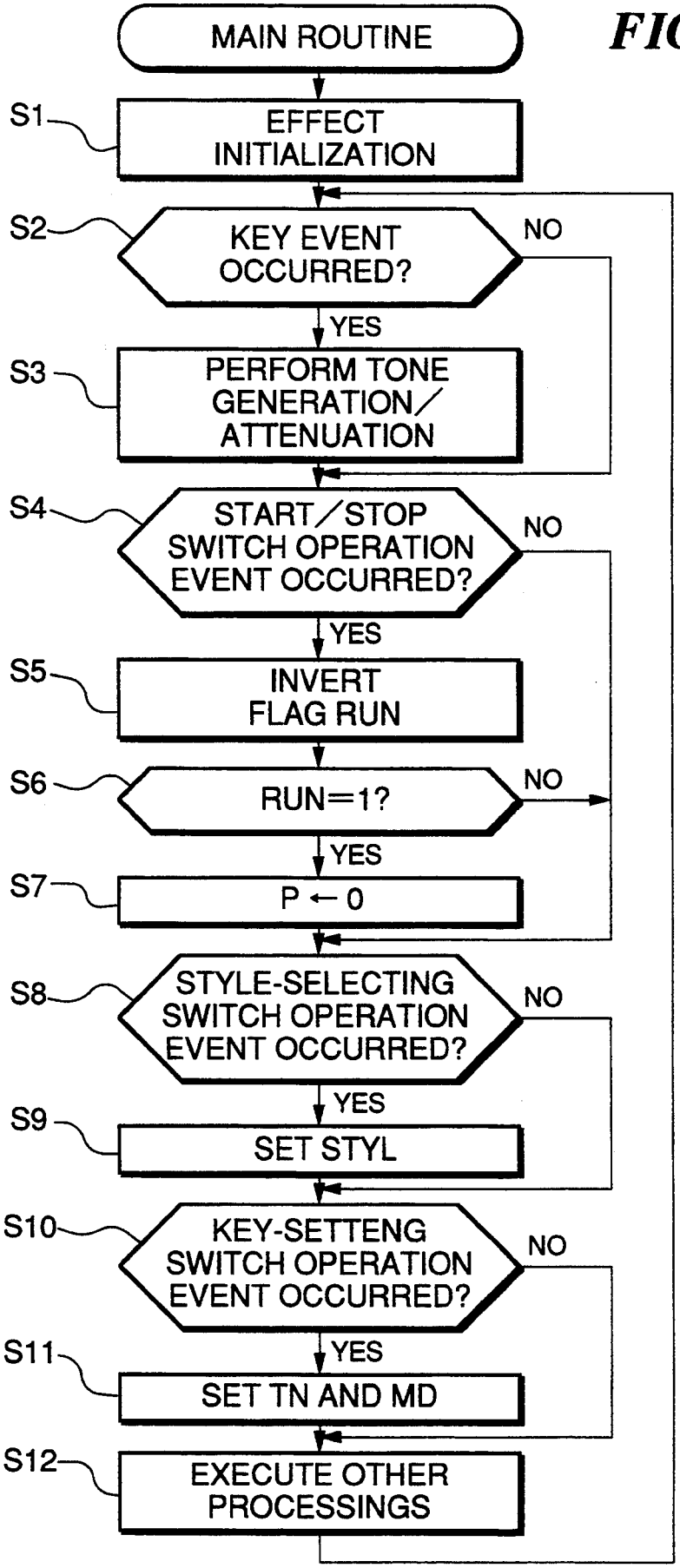
FIG. 3 is a flowchart showing a main routine executed by a central processing unit (CPU) appearing in FIG. 1.

FIG. 3 shows a main routine. At a step S1, various parameters for operation of the electronic musical instrument are initialized. Then, it is determined at a step S2 whether or not any key-depression event (key depression or key release) has occurred at the keyboard 1. If any key-depression event has occurred, a tone-generating operation/tone-attenuating operation is performed at a step S3, whereas if no key-depression event has occurred, the program jumps to a step S4, where it is determined whether or not a start/stop switch operation event has occurred. If the start/stop switch operation event has not occurred, the program jumps to a step S8, whereas if the event has occurred, the program proceeds to a step S5, where a flag RUN is inverted (i.e. when it is equal to "1", it is set to "0", whereas if it is equal to "0", it is set to "1"), and then at a step S6 it is determined whether or not the flag RUN is equal to "1". The flag RUN is set to "1" during execution of the automatic accompaniment, and if it is equal to "0", the program jumps to the step S8, whereas if it is equal to "1", the program proceeds to a step 7, where the indication value P of the address pointer is set to "0" representing an address of the chord progression memory 8 for starting the automatic accompaniment, and at the same time a counter, not shown, for determining tone-generating timing is reset.

Thus, according to the steps S4 to S7, when the flag RUN is changed from "0" to "1", i.e. when the start of the automatic accompaniment is instructed, the address pointer is set to "0" and the counter for determining tone-generating timing is reset.

At the step S8, it is determined whether or not a style-selecting switch operation event has occurred. If the event has not occurred, the program jumps to a step S10, whereas if the event has occurred, the style number designated by the style-selecting switch is set as a style number STYL at a step S9. At the step S10, it is determined whether or not a key-setting switch operation event has occurred. If the key-setting switch operation event has not occurred, the program jumps to a step S12, whereas if it has occurred, the tonic of the key set by the key-setting switch is set as tonic data TN and the mode (major or minor) of the key is set as mode data MD at a step S11. At the following step S12, the other processes are carried out, followed by the program returning to the step S2.

Thus, according to the steps S8 to S11, the style number STYL, and the tonic data TN of the set key and the mode data MD of same are set according to the operative states of the switches of the switch panel 2.

Figure 4:
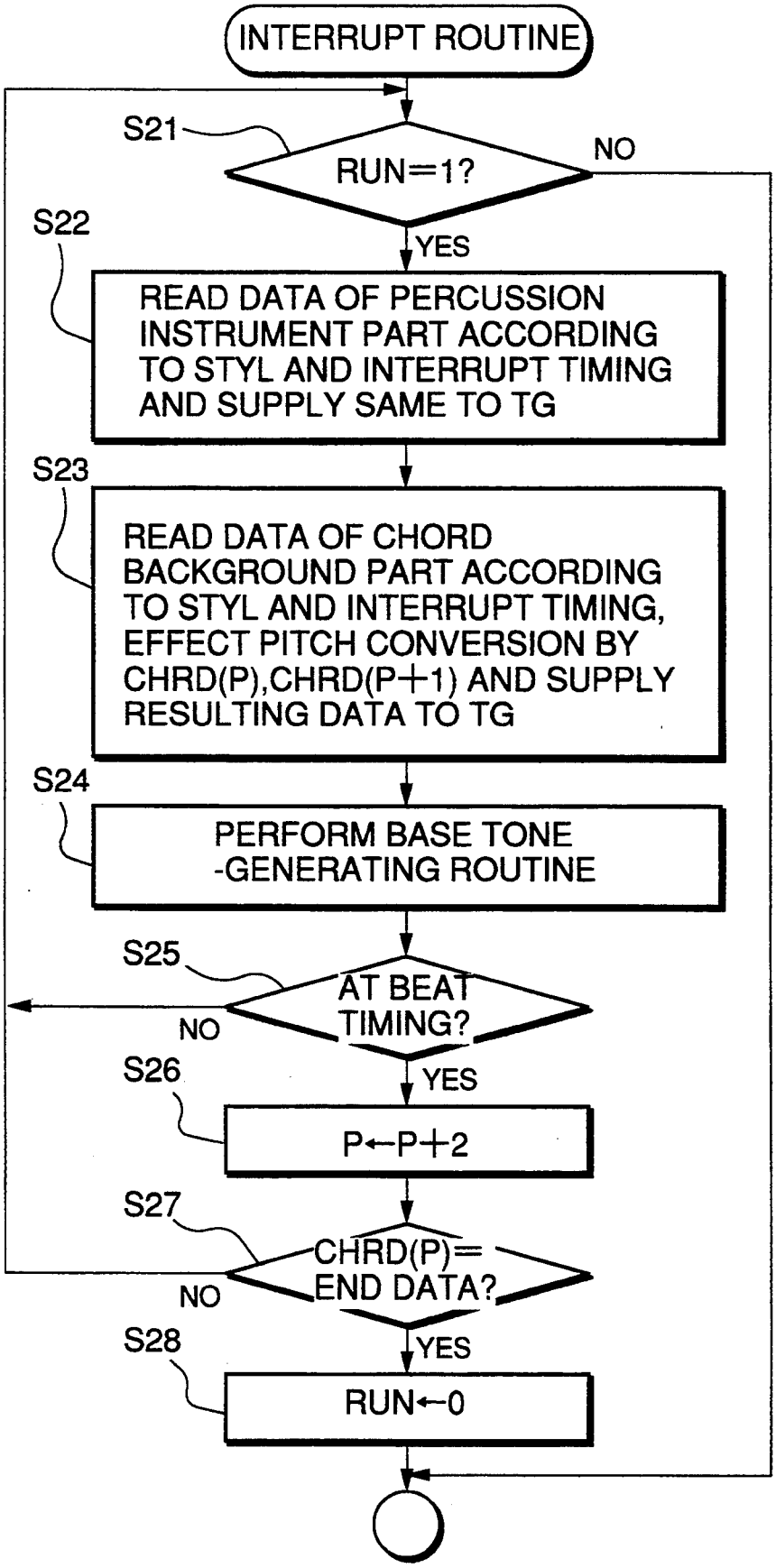
FIG. 4 is a flowchart showing an interrupt routine for generating accompaniment tones, executed by the central processing unit.

FIG. 4 shows an interrupt routine for generating accompaniment tones for the automatic accompaniment, which is executed every 1/64 beats in terms of a whole note (i.e. 16 times for the duration of one quarter note).

At a step S21, it is determined whether or not the flag RUN is equal to "1". If the flag RUN is equal to "0", the present routine is immediately terminated, whereas if it is equal to "1", accompaniment pattern data of the percussion instrument part is read from the accompaniment pattern memory 10 according to the style number STYL and the present interrupt timing, and the read accompaniment pattern data is delivered to the tone generator 11 for reproduction at a step S22. Then, accompaniment pattern data of the chord background part is read from the accompaniment pattern memory 10 according to the style number STYL and the present interrupt timing, and the read data is subjected to pitch conversion according to chord progression data CHRD (P) and CHRD (P+1) read from the chord progression memory 8, and the pitch-converted data is delivered to the tone generator 11 for reproduction at a step 23. CHRD (P) represents data of the root of a chord, and CHRD (P+1) data of the type of the chord.

Figure 5A:
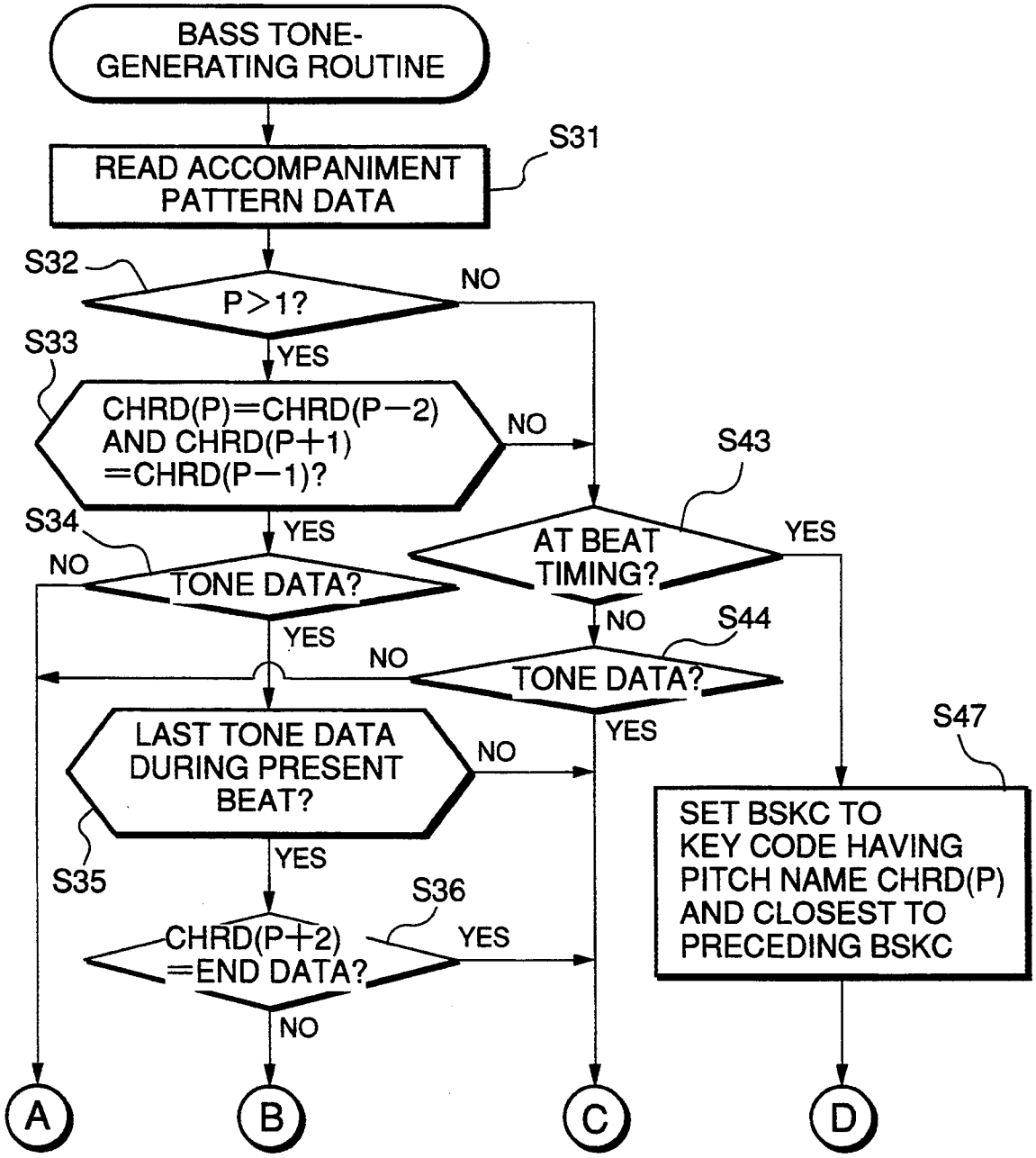
FIG. 5A is part of a flowchart showing a bass tone-generating routine.
Figure 5B:
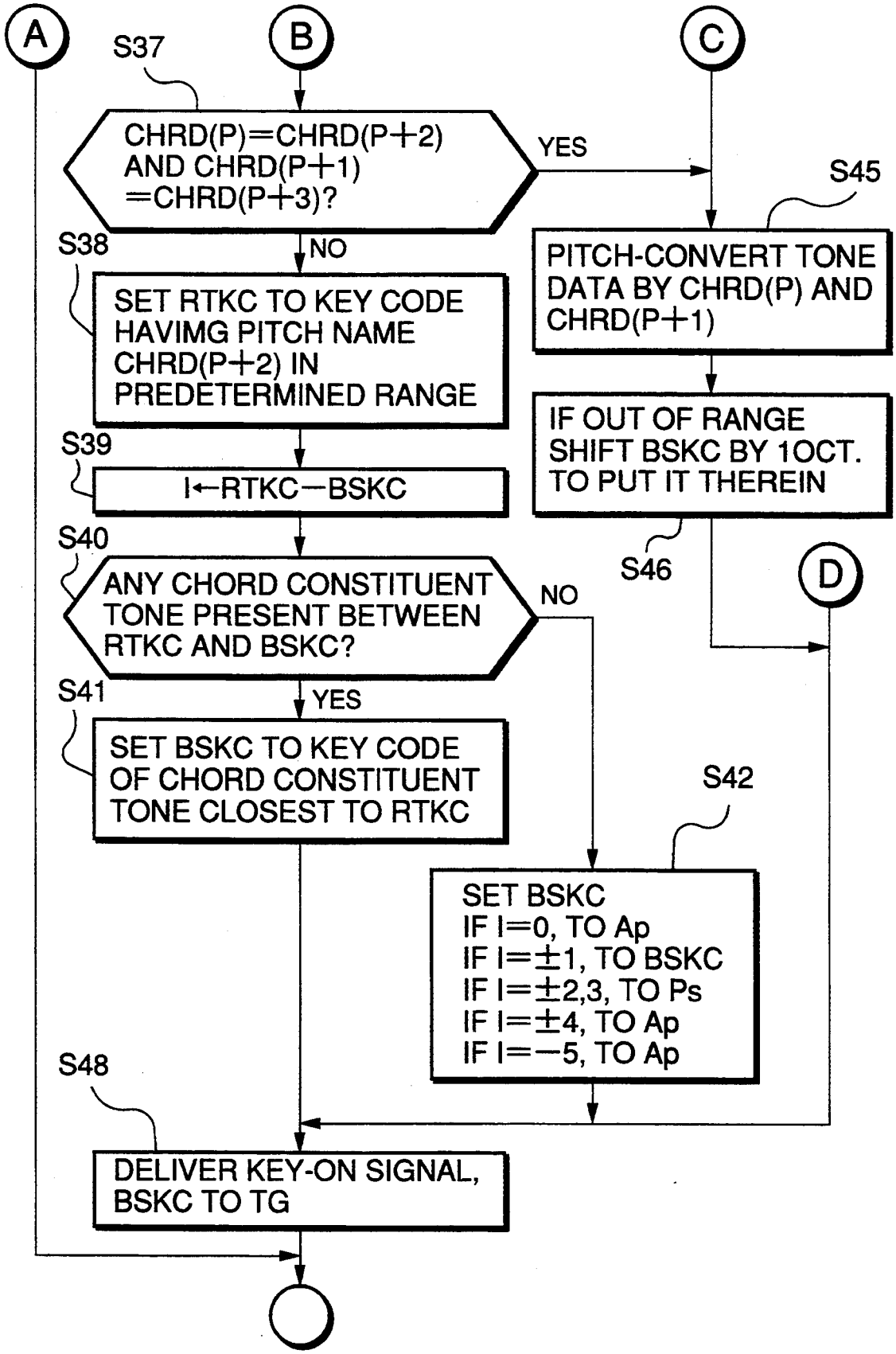
FIG. 5B is the rest of the flowchart showing the bass tone-generating routine.

At the following step S24, a bass tone-generating routine for generating accompaniment pattern data of the bass part, described hereinafter with reference to FIGS. 5A and 5B, is executed. Then, at a step S25, it is determined whether or not the present loop corresponds to beat timing, i.e. timing of start of a quarter note. If the present loop does not correspond to the beat timing, the program returns to the step S21. If the present loop corresponds to the beat timing, the program proceeds to a step S26, where the indication value P of the address pointer is incremented by two to read the root of a chord and the type of the chord from the next addresses. Then, it is determined at a step S27 whether or not chord data stored in the address having the updated address number of the chord progression memory is the end data. If the chord data is the end data, the flag RUN is set to "0" at a step S28, whereas if it is not the end data, the program returns to the step S21.

The bass tone-generating process carried out at the step S24 will be described in detail with reference to FIGS. 5A and 5B. Referring first to FIG. 5A, at a step S31, accompaniment pattern data of the bass part is read from the accompaniment patter memory 10 similarly to the step S22 of the FIG. 4 routine. Then at a step S32, it is determined whether or not the indication value P of the address pointer is larger than "1". If the answer to the question is negative (NO), i.e. if the address pointer value P is equal to "0" (sine the indication value P is incremented by two each time, it assumes a value of "0" or "an even number"), it is determined at a step S43 whether or not the present loop corresponds to the beat timing, i.e. timing of start of a quarter note. If the present loop corresponds to the beat timing, a key code BSKC for the bass part (hereinafter referred to as "the bass key code") is set to a key code (chord root key code) having a pitch name (e.g. "Do") identical to the root of the present data item CHRD (P), which is closest to the bass key code used on the immediately preceding occasion, and then the program proceeds to a step S48 in FIG. 5B, where a key-on signal and the bass key code are delivered to the tone generator 11, followed by terminating the program. In this connection, if there is no bass key code BSKC used in the immediately preceding loop, a key code having a pitch name identical to the root of the present data item CHRD (P) and falling within a predetermined tone range is set to the bass key code BSKC at the step S47. Thus, at the beat timing, a bass tone is necessarily generated for the bass part of the accompaniment based on the bass key code BSKC having a pitch dependent on the present chord. The predetermined tone range is set to a range of a particular one octave (e.g. a lower tone range suitable for the bass part) selected from the entire reproducible tone range.

If the answer to the question of the step S43 is negative (NO), i.e. if the present loop does not correspond to the beat timing, it is determined at a step S44 whether or not the data of accompaniment pattern read from the accompaniment pattern memory 10 at the step S31 is tone data. If the accompaniment pattern data is not tone data, the present routine is immediately terminated, whereas if it is tone data, the program proceeds to a step S45 in FIG. 5B, where the tone data is subjected to pitch conversion according to the chord progression data items CHRD (P) for the root of the chord and CHRD (P+1) for the type of the chord selected in the present loop, and the thus pitch-converted data is set to the bass key code BSKC. Then, if the bass key code BSKC falls outside a predetermined accompaniment tone range, the pitch of the bass key code BSKC is shifted to a pitch higher by one octave so that the code BSKC falls within the predetermined accompaniment tone range, at a step S46, and then the program proceeds to the step S48. The accompaniment pattern data is not set such that tone data, which comprises pitch data, is generated every interrupt timing (every interval of 1/16 of the duration corresponding to a quoter note), but it is set such that it is generated, e.g. every fourth interrupt timing. Thus, in this embodiment, a bass tone is continuously generated for the bass part over a time period corresponding to the duration of a sixteenth note, based on one bass key code BSKC set by the present routine.

If the answer to the question of the step S32 is affirmative (YES), i.e. if $P>1$, it is determined at a step S33 whether or not the present chord progression data CHRD (P) and CHRD (P+1) are identical to the immediately preceding chord progression data CHRD (P−2) and CHRD (P−1). If one or both of the present data are different from the immediately preceding data, the program proceeds to the step S43.

Thus, immediately after the automatic accompaniment has been started (P=0, or 1), or when the chord has been changed, the steps S43 to S47 are carried out.

If the answer to the question of the step S33 is affirmative (YES), i.e. if the present chord progression data CHRD (P) and CHRD (P+1) are identical to the immediately preceding chord progression data CHRD (P−2) and CHRD (P−1), it is determined at a step S34 whether or not the accompaniment pattern data read from the accompaniment pattern memory 10 at the step S31 is tone data. If the read data is not tone data, the present routine is immediately terminated, whereas if it is tone data, the program proceeds to a step S35, where it is determined whether or not the tone data is the last tone data read during the beat of the present quarter note. Then, the program proceeds to a step S36, where it is determined whether or not the chord progression data CHRD (P+2) to be selected on the next occasion is the end data. If the tone data is not the last tone data read during the present beat, or if the next data CHRD (P+2) is the end data, the program proceeds to the step S45 in FIG. 5B.

If the present tone data is the last tone data, and at the same time the next chord progressing data CHRD (P+2) is not the end data, the program proceeds to a step S37 in FIG. 5B, where it is determined whether or not the present chord progression data CHRD (P) and CHRD (P+1) are identical to the next chord progression data CHRD (P+2) and CHRD (P+3). If the answer to this question is affirmative (YES), the program proceeds to the step S45, whereas if the answer is negative (NO), a key code having a pitch name identical to the root of the data item CHRD (P+2) and falling within the aforementioned predetermined tone range is set to a destination tone key code RTKC at a step S38, and then a calculation is made of a difference I (=RTKC−BSKC) between the destination tone key code RTKC and the immediately preceding key code BSKC at a step S39. The difference I is represented by the number of semitones which can be present between RTKC and BSKC.

At the following step S40, it is determined whether or not there is/are any chord constituent tone corresponding to the chord progression data CHRD (P) and CHRD (P+1) and falling between the destination tone key code RTKC and the immediately preceding bass key code BSKC (exclusive of the key codes RTKC and BSKC). If the answer is affirmative (YES), a key code corresponding to a chord constituent tone closest to the destination tone key code RTKC is set to the bass key code BSKC at a step S41, followed by the program proceeding to the step S48.

On the other hand, if the answer to the question of the step S40 is negative (NO), i.e. if there is no chord constituent tone corresponding to the chord progression data CHRD (P) and CHRD (P+1) which falls between the key codes RTKC and BSKC, the bass key code BSKC is set according to the difference I at a step S42 in the following manner:

1) If I=0, BSKC=Ap
2) If I=±1, BSKC=BSKC(same)
3) If I=±2, 3, BSKC=Ps
4) If I=±4, −5, BSKC=Ap and then, the program proceeds to the step S48. In the above equations, Ap represents a key code of an appoggiatura, i.e. a tone which is higher than the destination tone of the destination tone key code by a 2nd degree (which is either a minor 2nd degree or a major 2nd degree depending on the key of the selected scale), Ps a key code of a passing tone, i.e. a key code of a tone between two tones within a 3rd degree ($-5<I<+5$), and BSKC(same) the immediately preceding bass key code BSKC.

In addition, if I=±3, there are two passing tones Ps, and in this case a tone on the scale having a set key is selected. If both the passing tones are on the scale, a key code of a tone closer to the destination tone key code RTKC is set to the bass key code BSKC.

As described heretofore, according to the present embodiment, when the chord progression data CHRD (P) is to be changed, the key code of the last tone data during a beat immediately before this change of the chord is changed to a key code of a chord constituent tone closest to the destination tone key code RTKC at the step S41, or to a key code of appoggiatura Ap or passing tone Ps or the same bass key code BSKC used as the immediately preceding bass key code at the step S42 according to the difference I between the destination tone key code RTKC and the immediately preceding bass key code BSKC. Therefore, it is possible to perform accompaniment in a more natural manner without the pitch of the accompaniment tone being jumped in an awkward manner when the chord has been changed. Particularly, according to the present embodiment, not only a passing tone but also an appoggiatura is selectively used during an interval between the pitch of the destination tone and that of the present tone, which realizes a complicated but natural passage of tone in which the pitch of the destination tone is once passed by and then reached.

Although in the above described embodiment the bass part alone is subjected to the processing of making smooth the flow of accompaniment when the chord has been changed, this is not limitative, but the chord background part may also be subjected to a similar processing.

Further, although in the above described embodiment the accompaniment-smoothing process is performed every beat of one quarter note, this is not limitative, but the processing may be performed at the last beat of a bar (i.e. at the fourth beat in four-four meter, for instance).

Further, although in the above embodiment the key of scale is designated by the key-setting switch, it may be automatically determined by the chord progression. This variation is preferred since it is possible to dispense with the key-setting switch, and further cope with modulation in the course of performance of accompaniment.

Further, although no detailed description related to the scale has been made, the whole-note scale is intended in the above embodiment. However, the present invention is not limited to the whole-note scale, but it may be applied to various scales, including those of folk music.

Further, since in the above described embodiment, at the outset of a beat immediately after the chord progression data CHRD (P) and CHRD (P+1) have been changed, the bass key code BSKC is set to a key code having a pitch name identical to the root (CHRD (P)) of the present chord, which is closest to the bass key code used on the immediately preceding occasion. Therefore, as distinct from the conventional case where pitch conversion of accompaniment data is performed based on tone data of accompaniment pattern data in relation to a selected chord, it is possible to prevent a drastic change in pitch, and hence to perform automatic accompaniment with a more natural flow of tones.

What is claimed is:

1. An automatic accompaniment instrument for automatically performing an accompaniment that is based on a chord progression formed by a sequence of chords, comprising:

accompaniment pattern storing means for storing an accompaniment pattern;

accompaniment tone reproducing means for reproducing an accompaniment tone according to said accompaniment pattern;

chord change-detecting means for detecting a change in said chord progression and for generating an output; and accompaniment tone control means responsive to the output from said chord change-detecting means for controlling a pitch of said accompaniment tone in said accompaniment pattern to be reproduced, said accompaniment tone to be reproduced being based on either a present chord or an immediately following chord of said chord progression, as well as on a pitch of an accompaniment tone generated on an immediately preceding occasion, such that when a change in said chord progression is detected by said chord change-detecting means, said accompaniment tone to be reproduced is generated immediately before or immediately after said change in said chord progression.

2. An automatic accompaniment instrument according to claim 1, wherein the pitch of said accompaniment tone to be reproduced is controlled based on the pitch of said accompaniment tone generated on said immediately preceding occasion, and said present chord of said chord progression, when said change in said chord progression has just occurred.

3. An automatic accompaniment instrument according to claim 2, wherein the pitch of said accompaniment tone to be reproduced is set to a pitch of a tone which is closest to the pitch of said accompaniment tone generated on said immediately preceding occasion and has a pitch name identical to a root of said present chord of said chord progression.

4. An automatic accompaniment instrument according to claim 1, wherein the pitch of said accompaniment tone to be reproduced is controlled based on the pitch of said accompaniment tone generated on said immediately preceding occasion, and said immediately following chord of said chord progression, when said change in said chord progression is about to occur.

5. An automatic accompaniment instrument according to claim 4, wherein if there is at least one chord constituent tone corresponding to said present chord of said chord progression falling between the pitch of said accompaniment tone generated on said immediately preceding occasion and a pitch of a tone falling within a predetermined tone range and having a pitch name identical to a root of said immediately following chord of said chord progression, the pitch of said accompaniment tone to be reproduced is set to a pitch of one of said at least one chord constituent tone corresponding to said present chord which is closest to the pitch of said tone falling within said predetermined tone range and having said pitch name identical to said root of said immediately following chord of said chord progression.

6. An automatic accompaniment instrument according to claim 4, wherein if there is no chord constituent tone corresponding to said present chord of said chord progression falling between the pitch of said accompaniment tone generated on said immediately preceding occasion and a pitch of a tone falling within a predetermined tone range and having a pitch name identical to a root of said immediately following chord of said chord progression, the pitch of said accompaniment tone to be reproduced is set to a pitch of a non-chord constituent tone according to a difference between the pitch of said accompaniment tone generated on said immediately preceding occasion and the pitch of said tone falling within said predetermined tone range and having said pitch name identical to said root of said immediately following chord of said chord progression.

7. An automatic accompaniment instrument according to claim 4, wherein if there is at least one chord constituent tone corresponding to said present chord of said chord progression falling between the pitch of said accompaniment tone generated on said immediately preceding occasion and a pitch of a beginning tone corresponding to said immediately following chord of said chord progression, the pitch of said accompaniment tone to be reproduced is set to a pitch of one of said at least one chord constituent tone corresponding to said present chord which is closest to the pitch of said beginning tone corresponding to said immediately following chord of said chord progression.

8. An automatic accompaniment instrument according to claim 4, wherein if there is no chord constituent tone corresponding to said present chord of said chord progression falling between the pitch of said accompaniment tone generated on said immediately preceding occasion and a pitch of a beginning tone corresponding to said immediately following chord of said chord progression, the pitch of said accompaniment tone to be reproduced is set to the pitch of a non-chord constituent tone according to a difference between the pitch of said accompaniment tone generated on said immediately preceding occasion and the pitch of said beginning tone corresponding to said immediately following chord of said chord progression.

9. An automatic accompaniment instrument for automatically performing an accompaniment that is based on a chord progression formed by a sequence of chords, comprising:

accompaniment pattern storing means for storing an accompaniment pattern;

accompaniment tone reproducing means for reproducing an accompaniment tone according to said accompaniment pattern;

chord change-detecting means for detecting a change in said chord progression and for generating an output;

accompaniment tone control means responsive to the output from said chord change-detecting means for controlling a pitch of said accompaniment tone in said accompaniment pattern to be reproduced, said accompaniment tone to be reproduced being based on either a present chord or an immediately following chord of said chord progression, such that said accompaniment tone to be reproduced is generated immediately before or immediately after said change in said chord progression.

10. An automatic accompaniment instrument according to claim 9, including scale-selecting means for selecting a scale of said accompaniment tone to be reproduced, and wherein the pitch of said accompaniment tone to be reproduced is controlled based on a key of a scale selected by said scale-selecting means.

11. A method of automatically performing an accompaniment that is based on a chord progression formed by a sequence of chords, the method comprising the steps of:

storing an accompaniment pattern;

reproducing an accompaniment tone according to said accompaniment pattern;

detecting a change in said chord progression;

producing a signal indicative of a detected chord change;

controlling a pitch of said accompaniment tone in said accompaniment pattern to be reproduced when said signal indicates a chord change, said accompaniment tone to be reproduced being based on either a present chord or an immediately following chord of said chord progression; and generating said accompaniment tone to be reproduced immediately before or immediately after said change in said chord progression.

12. The method according to claim 11, further including the step of further controlling the pitch of the accompaniment tone to be produced also based on a pitch of an accompaniment tone generated on an immediately preceding occasion.

13. The method according to claim 12, further including the step of controlling the pitch of said accompaniment tone to be reproduced based on the pitch of said accompaniment tone generated on said immediately preceding occasion and said present chord of said chord progression, when said change in said chord progression has just occurred.

14. The method according to claim 13, further including the step of setting the pitch of said accompaniment tone to be reproduced to a pitch of a tone which is closest to the pitch of said accompaniment tone generated on said immediately preceding occasion and which has a pitch name identical to a root of said present chord of said chord progression.

15. The method according to claim 12, further including the step of controlling the pitch of said accompaniment tone to be reproduced based on the pitch of said accompaniment tone generated on said immediately preceding occasion and said immediately following chord of said chord progression, when said change in said chord progression is about to occur.

16. The method according to claim 15, wherein if there is at least one chord constituent tone corresponding to said present chord of said chord progression falling between the pitch of said accompaniment tone generated on said immediately preceding occasion and a pitch of a tone falling within a predetermined tone range and having a pitch name identical to a root of said immediately following chord of said chord progression, the method further includes the step of:

setting the pitch of said accompaniment tone to be reproduced at a pitch of one of said at least one chord constituent tone corresponding to said present chord which is closest to the pitch of said tone falling within said predetermined tone range and having said pitch name identical to said root of said immediately following chord of said chord progression.

17. The method according to claim 15, wherein if there is no chord constituent tone corresponding to said present chord of said chord progression falling between the pitch of said accompaniment tone generated on said immediately preceding occasion and a pitch of a tone falling within a predetermined tone range and having a pitch name identical to a root of said immediately following chord of said chord progression, the method further includes the step of:

setting the pitch of said accompaniment tone to be reproduced to a pitch of a non-chord constituent tone according to a difference between the pitch of said accompaniment tone generated on said immediately preceding occasion and the pitch of said tone falling within said predetermined tone range and having said pitch name identical to said root of said immediately following chord of said chord progression.

18. The method according to claim 15, wherein if there is at least one chord constituent tone corresponding to said present chord of said chord progression falling between the pitch of said accompaniment tone generated on said immediately preceding occasion and a pitch of a beginning tone corresponding to said immediately following chord of said chord progression, the method further includes the step of:

setting the pitch of said accompaniment tone to be reproduced to a pitch of one of said at least one chord constituent tone corresponding to said present chord which is closest to the pitch of said beginning tone corresponding to said immediately following chord of said chord progression.

19. The method according to claim 15, wherein if there is no chord constituent tone corresponding to said present chord of said chord progression falling between the pitch of said accompaniment tone generated on said immediately preceding occasion and a pitch of a beginning tone corresponding to said immediately following chord of said chord progression, the method further includes the step of:

setting the pitch of said accompaniment tone to be reproduced to the pitch of a non-chord constituent tone according to a difference between the pitch of said accompaniment tone generated on said immediately preceding occasion and the pitch of said beginning tone corresponding to said immediately following chord of said chord progression.

20. The method according to claim 11, further including the steps of:

selecting a scale of said accompaniment tone to be reproduced; and further controlling the pitch of said accompaniment tone to be reproduced based on a key of the selected scale.

* * * * *